US005836330A

United States Patent [19]

Franklin

[11] Patent Number: 5,836,330

[45] Date of Patent: Nov. 17, 1998

[54] SUSPENDED OVERHEAD CANOPY ASSEMBLY AND METHOD THEREFORE

[76] Inventor: Linsey Franklin, 1340 Marshall St., Boulder, Colo. 80302

[21] Appl. No.: 552,137

[22] Filed: Nov. 2, 1995

[51] Int. Cl.[6] ..... E04H 15/04

[52] U.S. Cl. ..... 135/90; 135/96; 5/414

[58] Field of Search ..... 135/90, 96, 115, 135/909; 5/414

[56] References Cited

U.S. PATENT DOCUMENTS

| | | | |
|---|---|---|---|
| 294,088 | 2/1884 | Smith . | |
| 654,156 | 7/1900 | Johnson . | |
| 671,912 | 4/1901 | Woodward . | |
| 739,024 | 9/1903 | Palmer . | |
| 2,440,557 | 4/1948 | Power . | |
| 2,699,794 | 1/1955 | Potter | 5/414 X |
| 3,424,178 | 1/1969 | Yazaki | 135/909 X |
| 3,741,225 | 6/1973 | Gunter | 135/96 X |
| 3,956,784 | 5/1976 | Vargas . | |
| 4,068,333 | 1/1978 | Gunter | 135/96 X |
| 4,074,377 | 2/1978 | Gunter | 135/96 X |
| 4,293,162 | 10/1981 | Pap et al. | 135/96 X |
| 4,295,482 | 10/1981 | McMullen . | |
| 4,729,137 | 3/1988 | Denney . | |
| 4,785,837 | 11/1988 | Hansen et al. . | |
| 4,821,349 | 4/1989 | Cohen . | |
| 4,926,892 | 5/1990 | Osmonson et al. | 135/909 X |
| 4,945,584 | 8/1990 | LaMantia . | |
| 4,945,586 | 8/1990 | Cross et al. . | |

FOREIGN PATENT DOCUMENTS

| | | | |
|---|---|---|---|
| 2247259 | 2/1992 | United Kingdom | 135/96 |

OTHER PUBLICATIONS

Colorado Homes & Lifestyles, May/Jun. 1993, "Covered by Karma and Canopies".

*Primary Examiner*—Lanna Mai

*Attorney, Agent, or Firm*—Finnegan, Henderson, Farabow, Garrett & Dunner, L.L.P.

[57] ABSTRACT

A canopy assembly available in a wide range of configurations, sizes and decor. The canopy assembly of the present invention consists of several components. These components include an easily fabricated canopy cover. The assembly also includes suspension frame members for forming a suspension frame which is affixed to the canopy cover. Surface mounts are included for insertion into an overhead structure. Suspension line is included to suspend the suspension on frame from the surface mounts.

6 Claims, 7 Drawing Sheets

SUSPENDED OVERHEAD CANOPY ASSEMBLY AND METHOD THEREFORE

BACKGROUND OF THE INVENTION

1. Field of the Invention

This invention relates to the field of suspended overhead canopies, and particularly to the field of assembly kits for creating suspended overhead canopies.

2. Statement of the Problem

Canopies have long been used since medieval ages as a decorative overhead item. These canopies have been used over beds, tables, thrones, sacred objects, exalted personages and the like. In modern times, canopies enjoy popular use as overhead bed canopies, awnings, and other household uses.

One example of overhead canopies is for bed canopies. Overhead bed canopies have long been used to create a stylish bedroom decor. Bed canopies have traditionally been supported over a bed by a heavy structural frame formed integrally with the bed frame. Typically, the structural frame for bed canopies includes upstanding wooden posts at each corner of the bed. Overhead rails extend between each of the corner posts. Additional support rails may also extend between the side overhead rails.

These prior bed canopies, while being decorative, are expensive. These canopies are configured for particular beds having the required corner posts and overhead rails. This limits the use of canopies due to their structure and expense. While many people may desire to enhance a bedroom by using a bed canopy, there are limits to the opportunity to do so. Typically an individual must purchase an additional bed having the requisite structure at relatively high expense. These beds are not only quite expensive, they will most likely not coordinate with the existing bedroom decor.

In choosing a bed canopy for decorating a bedroom, an individual is constrained to use existing bed designs, canopy designs and fabric designs. All of these designs are usually limited in selection. This not only constrains the available options in decorating a bedroom but also limits the opportunity to redecorate at a later time.

While other types of home and institutional furnishings are readily available in the marketplace, overhead canopies have simply not been offered in an available form. The design of existing canopies, not only bed canopies but other types as well, prevent these canopies from being mass-marketed.

Since the existing canopy beds are relatively expensive, these beds are seldom used in hotel and motel rooms, hospitals, and other institutions. The cumbersome nature and weight of these beds is also a limiting factor.

Attempts to overcome the problems of these bed canopies have largely been unsuccessful. One example of a prior canopy is disclosed in U.S. Pat. No. 4,785,837, issued to Hansen et al. This patent discloses a canopy which is suspended over a bed by lines from the ceiling. This canopy uses a rigid board body with existing covers draped over the body. An individual is still required to purchase the rigid board body. This design is cumbersome and still relatively expensive, although less expensive than the use of corner posts and side rails. Also, selection of canopies is limited to existing covers already available on the market.

An additional prior art attempt at providing an affordable canopy is disclosed in U.S. Pat. No. 3,956,784, issued to Vargas. This patent discloses a portable canopy using spring-loaded telescopic corner posts. Curtain rods are bracketed to these corner posts. A canopy is draped from these curtain rods. This portable canopy is cumbersome and not readily fitted to many beds. These canopies require ceiling-to-floor corner posts. Both of these prior canopies are limited to use over beds, require cumbersome structural supports, and have limited selection of canopy covers.

Known prior canopies available in the marketplace are primarily limited to use as bed canopies. Other uses of overhead canopies have been limited since these canopies have associated problems discussed above. Although drapes, curtains, linens, tablecloths, bed coverings and other home and institutional furnishings are readily available in the market, prior to the present invention no one has designed a suspended canopy that fulfills the needs described above.

Thus, a problem exists in that there are no canopy assemblies presently available in a form for mass-marketing. There are additional problems in that there is no simple technique for creating an overhead canopy that can be tailored to fit a desired decor or created in a simple and quick manner.

3. Solution to the Problem

The present invention provides the conception and creation of an overhead canopy assembly that overcomes these and other problems. The present invention fills the market's inability to provide a source of an overhead suspended canopy that is easily fabricated for a myriad of uses. The present invention also creates an entire new market for such a canopy.

The canopy assembly of the present invention can be configured in an infinite variety of shapes and sizes to fit almost any situation and decor. A canopy style and a fabric can be easily provided to coordinate with and enhance almost any desired decor.

The canopy assembly can be mass-marketed for home use or for institutional uses. The canopy assembly can be packaged as finished goods to allow an individual to select a canopy according to their personal taste. The canopy assembly can be easily assembled from the packaged assembly. Most individuals can quickly assemble and mount the canopy with minimal effort. The finished canopy is lightweight and can be disassembled and reassembled as desired. The canopy can be easily and inexpensively changed as often as desired to allow for redecoration of the room.

Another feature of the canopy assembly of the present invention is the ability to start with a basic canopy and later add options. A variety of options are available to customize the canopy to a chosen design.

The canopy assembly is provided to the consumer as finished goods so a simple assembly process is all that is required. This allows the canopy assembly to marketed through existing channels, such as home furnishings including bed coverings, drapes, lines, etc. The canopy assembly can also be provided in a pattern form to allow a canopy cover to be fabricated by the consumer.

The canopy assembly of the present invention can also be marketed to institutions, such as hotels, hospitals, children's marketing sources and others. In this form, the canopy assembly can be offered in a mass quantities with coordinated associated items.

The canopy assemblies of the present invention have a wide range of applications. One particular application is for use as bed canopies. A selected canopy can be quickly assembled to fit almost any bedroom decor.

Other applications of the canopy assembly of the present invention include use to define an area in a large room, such as a child's play area. An indoor tent-like structure can even be created. This canopy assembly also has utility to designate exhibits or hospitality suites in convention trade shows.

The canopy assembly can also be used over a walk-in tub or spa. A table, particularly in an outdoor setting, might be covered by such a canopy if an overhead structure is available. Many other uses of such a canopy will become prevalent once the canopy is available in the marketplace.

These and other features of the present invention are fully disclosed in the following discussion of the canopy assembly.

SUMMARY OF THE INVENTION

The present invention provides a system of canopy assemblies. These canopy assemblies can be supplied as packaged finished goods ready to be assembled. This provides an item that can be mass-marketed through existing channels, such as home furnishings. The canopy assemblies can also be easily supplied to institutional users. The design of these canopy assemblies provides for a wide range of configurations and sizes to fit almost any desired design and decor. These canopy assemblies can be easily assembled by most individuals in their own home.

The canopy assembly as provided in one embodiment of the present invention consists of several components. These components, all of which are described in detail below, include selected fabric configured in desired shapes and sizes forming a canopy cover. The assembly also includes suspension frame members and connection members for forming a suspension frame which is affixed to the canopy cover. Surface mounts are included for insertion into an overhead structure. Lightweight suspension line, such as monofilament line, is included to suspend the suspension frame and canopy cover from the surface mounts.

The canopy assembly is preferably packaged as finished goods to allow the canopy to be assembled and mounted with minimal problems. This allows the canopy assembly to be marketed through existing channels by established manufacturers. Also, the canopy assemblies can be marketed directly to institutional buyers, such as hotels or hospitals.

In an alternative embodiment, the canopy assembly can be packaged with patterns and without fabric to provide the opportunity for an individual to select a fabric according to the decor and personal taste. The approximate fabric yardage requirements are included as part of the assembly. The fabric is then cut according to the canopy assembly patterns into the appropriately dimensioned sections. These sections are aligned and stitched together according to standard sewing principles. The canopy can even, in some situations, be formed of a single section of fabric. The unique patterns allow the creation of a canopy cover in a short time without the need of extraneous cutting and sewing. The unique pattern allows suspension pockets to formed integrally with the canopy cover. In a second alternative embodiment, suspension frame member pockets are cut separately and stitched to the top side of the canopy cover at this time.

Regardless whether the canopy cover is provided as finished goods or fabricated by the consumer, the assembly process is similar. The suspension frame members are inserted through the pockets. The connection members are used to connect the suspension frame members together to form a suspension frame affixed to the canopy cover. The suspension lines, cut to appropriate lengths, are looped and knotted on the connection members. The suspension lines can also be secured on other areas of either the suspension frame members or the canopy cover.

The surface mounts are secured to an overhead structure, such as a ceiling. The canopy cover is then suspended by the suspension lines from the surface mounts.

The edges of the canopy cover will drape downward from the suspension frame members to create a canopy effect. An alternative effect can be created by varying the contours of the draped edges to incorporate other designs. The insides of each of the corners form a pleat which can be tacked together to stiffen the canopy if desired.

Other options are available to customize the overhead canopy to an individuals personal taste. For instance, corner panels, headboards, and other decorative options can be added to the basic canopy assembly in a similar fashion.

The features and unique applications of the present invention will be evident in the ensuing detailed description of a preferred embodiment and from the drawings.

DETAILED DESCRIPTION OF A PREFERRED EMBODIMENT

The present invention provides an overhead canopy in a self-contained assembly. This canopy assembly is designed to be easily configured in a variety of configurations and sizes for wide ranging application. A canopy can be selected to fit almost any situation and decor.

A preferred embodiment of the present invention is described herein. It is to be expressly understood that the preferred embodiment described herein is not meant to limit the scope of the inventive concept. This exemplary embodiment is for descriptive purposes only. Other embodiments and variations are considered to be within the inventive concept.

Canopy Assembly Components

The canopy assembly of a preferred embodiment of the present invention consists of several components. These components, all of which are described in detail below, include selected fabric configured in desired shapes and sizes for forming a canopy cover. The assembly also includes suspension frame members and connection members for forming a suspension frame which is affixed to the canopy cover. Surface mounts are included for insertion into an overhead structure. Lightweight suspension line is included to suspend the suspension frame from the surface mounts.

As discussed in the background section, the canopy assembly of the present invention can be packaged as finished goods for marketing through existing trade channels, packaged in a pattern kit to allow for individual creation of canopy covers, and direct marketing to institutional users. Further, the application of these canopies is wide ranging, particularly as the market for this novel invention develops, since mass-marketed canopies were unavailable prior to this invention.

One use for these canopy assemblies is for suspension over a bed. This provides an inexpensive technique for enhancing the decor of a bedroom. One exemplary canopy assembly for use such with a rectangularly-shaped bed is discussed herein. It is to be expressly understood that the present invention is also intended to create canopies for most configurations and sizes of beds, as well as for other uses.

Canopy covers

Figure 1:
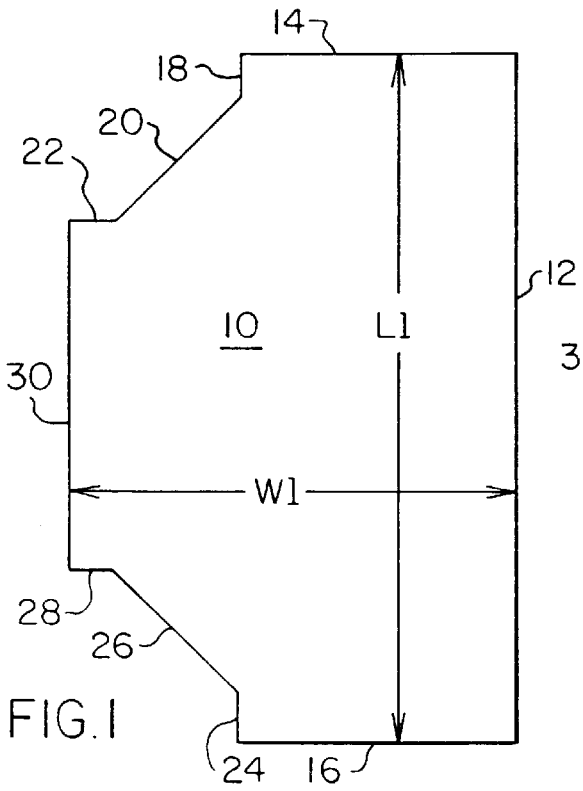
FIG. 1 is a top view of a section of fabric cut according to a pattern of a first preferred embodiment of the present invention.

Fabric section 10, shown in FIG. 1, is cut in accordance with a unique pattern of the present invention. Fabric section 10 includes substantially linear edge 12 perpendicular to side edges 14, 16. Edge 30 is cut in accordance with the pattern parallel to edge 12. Corner sections 20, 26 are formed by edges 18, 24 adjacent side edges 14, 16, respectively, and by edges 22, 28, adjacent edge 30. Section 10 has length $L_1$ and width $W_1$. The exact dimensions depend on the size and configuration of the finished canopy cover.

Figure 2:
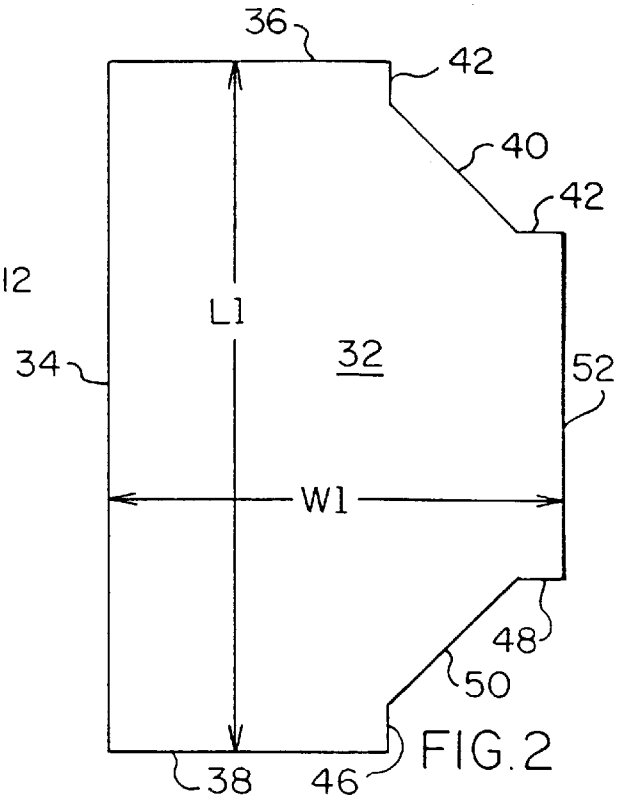
FIG. 2 is a view of a reverse section of fabric cut according to the pattern of FIG. 1.

Fabric section 32, shown in FIG. 2, is formed in a reverse fashion in accordance with the unique assembly patterns. Fabric section 32 includes edge 34, having a length $L_1$, and side edges 36, 38 extending substantially perpendicular therefrom. Edge 52 is cut parallel to and spaced distance $W_1$ from edge 34. Corner sections 40, 50 are formed by edges 42, 46 adjacent side edges 36, 38, respectively and by edges 44, 48 adjacent edge 52.

Figure 3:
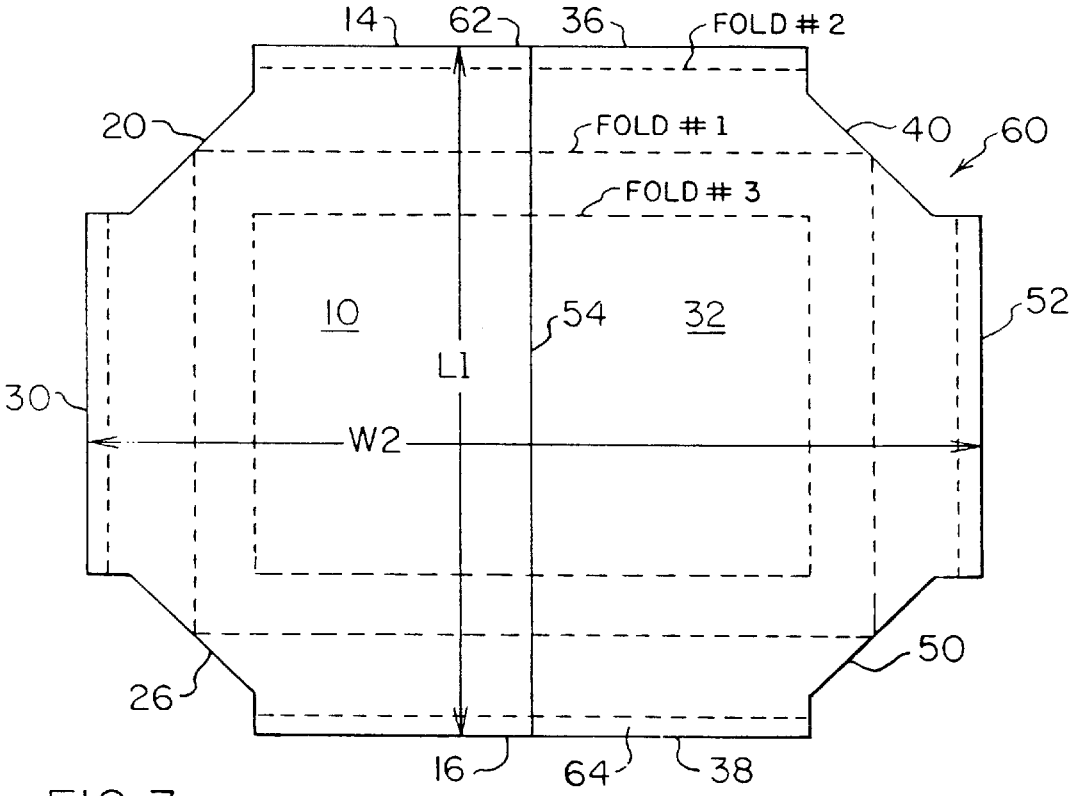
FIG. 3 is a view of the fabric sections of FIGS. 1 and 2 stitched together to form a canopy cover.

Fabric sections 10, 32 are secured together to form canopy cover 60, shown in FIG. 3. Edge 12 of fabric section 10 is aligned with edge 34 of fabric section 32 and stitched together along seam 54. Canopy cover 60 can also be formed of a single section of fabric if the appropriate pattern and fabric section dimensions are available. Canopy cover 60 thus has length $L_1$ and width $W_2$. Canopy cover 60 includes edges 30, 52 and elongated edges 62, 64. Corner sections 20, 26, 40, 50 also are formed in each corner of canopy cover 60.

Figure 4:
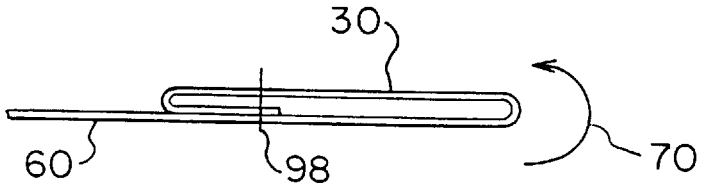
FIG. 4 is a sectional view of a corner of the canopy cover of FIG. 3.
Figure 5:
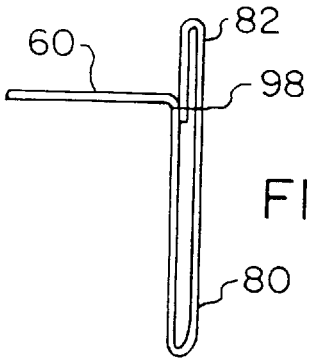
FIG. 5 is a cross-sectional view of the suspension frame pocket and downwardly-extending panel of the canopy cover.

Canopy cover 60 is now fabricated to form a rectangularly-shaped canopy having downwardly extending panels and suspension member pockets. Each corner of canopy cover 60 is folded in the manner of corner 20, as shown in FIG. 4. As shown in FIG. 4, edge 30 is folded in the direction of arrow 70. Once edge 30 is folded in half, it is stitched to hold in place. This stitched edge 30 is folded back to be in line with edge 18. Edge 30 is then folded in half in the reverse direction. This creates a downwardly-extending panel 80, shown in FIG. 5 with suspension pocket 82 extending upwardly.

Figure 6:
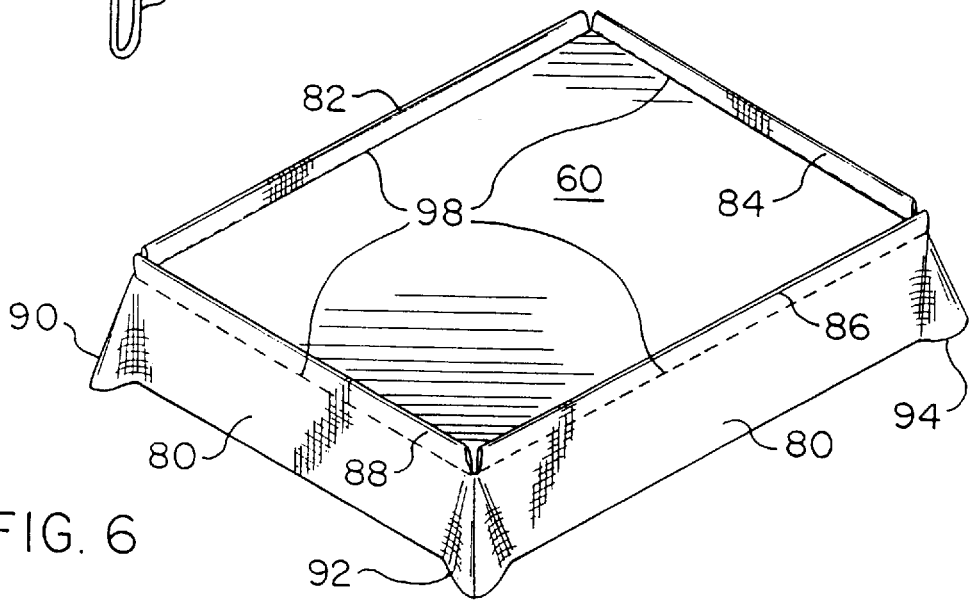
FIG. 6 is a perspective view of the canopy cover of the first embodiment.
Figure 7:
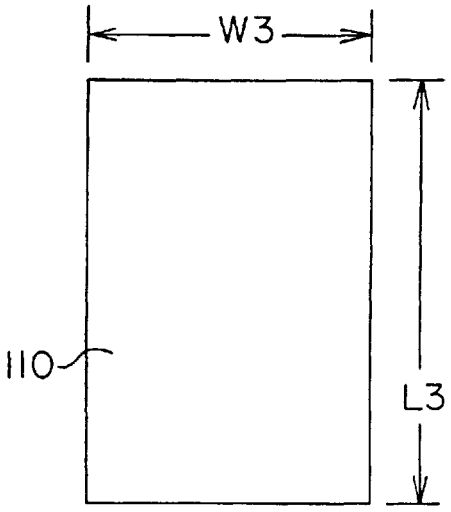
FIG. 7 is a top view of a section of fabric cut according to a pattern of a second preferred embodiment of the present invention.

Each of edges 30, 52, 62, 64 are formed in a similar fashion. Corners 90, 92, 94, 96 are thus formed, as shown in FIG. 6. The edges and corners are stitched along seams 98, to form suspension member pockets 82, 84, 86, 88. The edges and corners have hems sewn as necessary. This entire process can be accomplished by an individual having a modicum of sewing skill in less than fifteen minutes.

An alternative embodiment of creating a canopy cover is illustrated in FIGS. 7–10. Section 110, shown in FIG. 7, has a length $L_3$ and width $w_3$. This enables four sections 110, 112, 114, 116 (shown in FIG. 8) of fabric to be cut with these dimensions. The number, size and shape of these sections can be varied as necessary.

Figure 8:
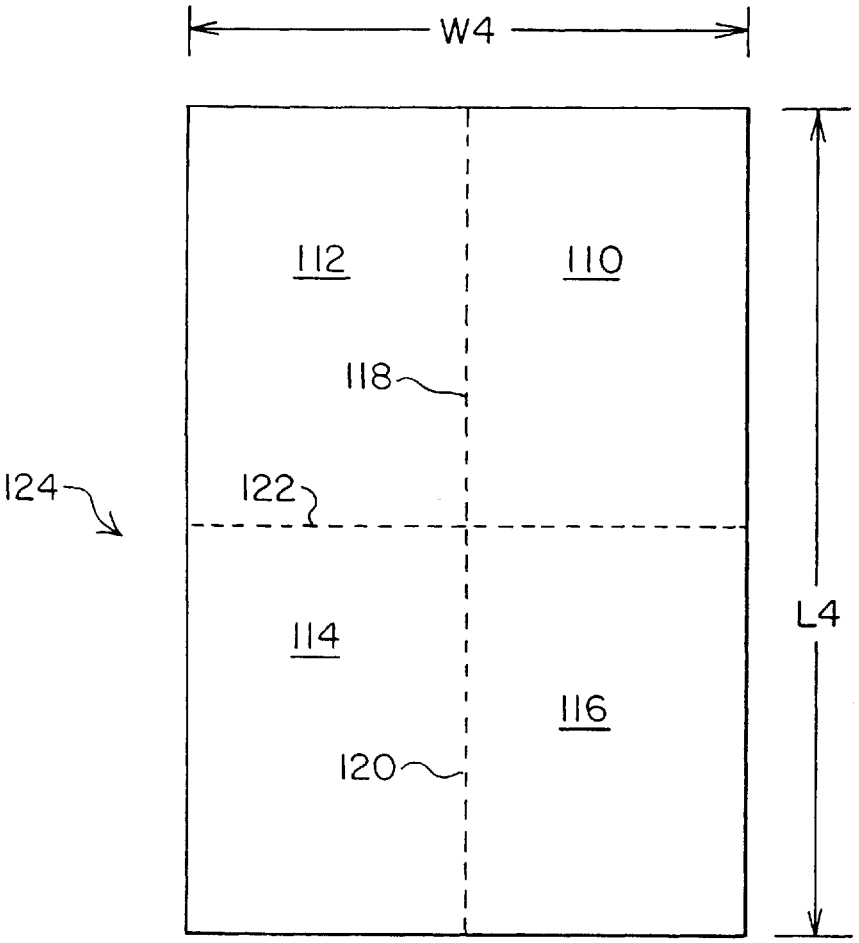
FIG. 8 is a top view of a plurality of fabric sections cut according to the pattern of the embodiment of FIG. 7 stitched together to form a canopy cover.

In accordance with another unique pattern of the present invention, fabric sections 110, 112, 114, 116 are aligned and stitched along seam lines 118, 120, 122, as shown in FIG. 8. This creates a single section having length $L_4$ and width $W_4$ to form canopy cover 124. Other techniques may be used to affix the sections together, particularly if the canopies are to be mass produced. The edges of canopy cover 124 are then basted and stitched to form a hem.

Figure 9:
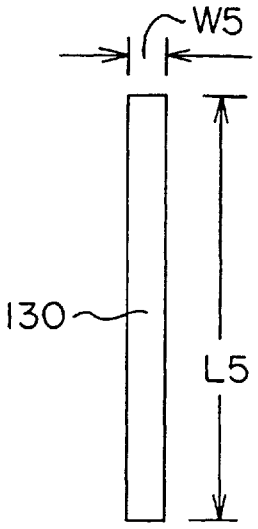
FIG. 9 is a top view of a section of fabric cut according to a second pattern of the canopy assembly of the embodiment of FIG. 7.

Fabric section 130, as shown in FIG. 9, is also formed according to a unique pattern having dimensions length $L_5$ and width $W_5$. Four fabric sections, 130, 132, 134, 136 are formed in this manner.

Figure 10:
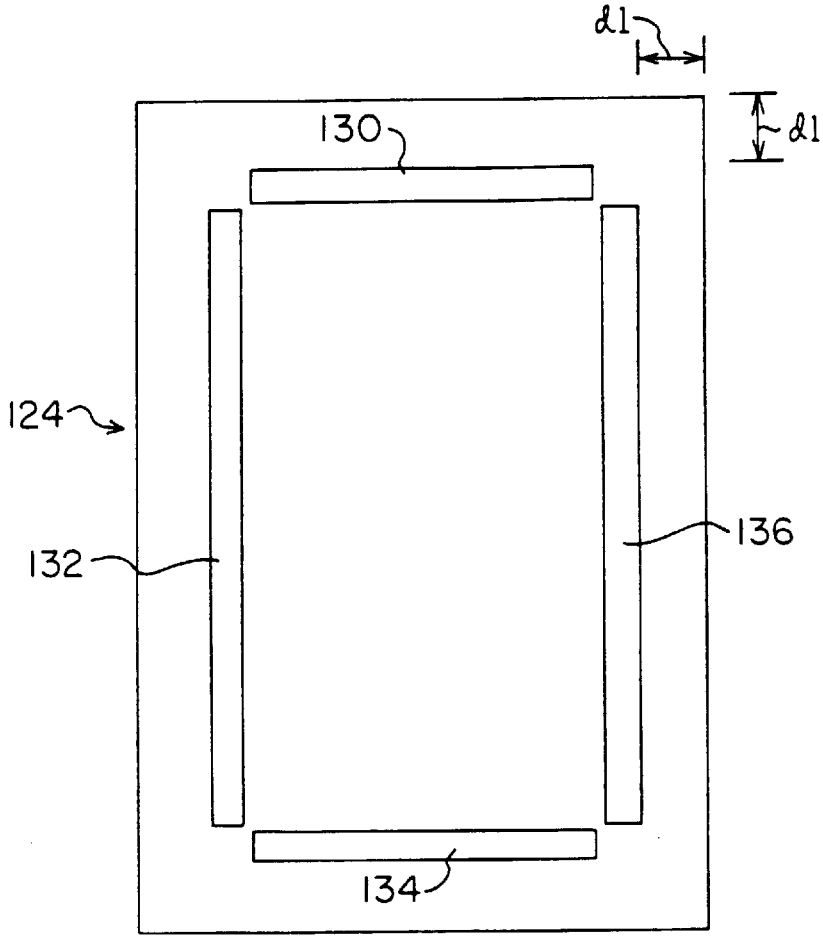
FIG. 10 is a top view of a plurality of the fabric sections of FIG. 9 stitched to the canopy cover of FIG. 8 to form pockets.

Fabric sections 130, 132, 134, 136 are stitched onto the top side of canopy cover 124, as shown in FIG. 10. Each of fabric sections 130, 132, 134, 136 are spaced a distance $d_1$ from the ends of canopy cover 124. These fabric sections form pockets for engagement with the suspension frame members, as discussed below. As discussed above, canopy covers 60, 124 are either packaged as finished goods, or provided in pattern form to allow creation of the canopy covers individually.

Suspension frame

Figure 11:
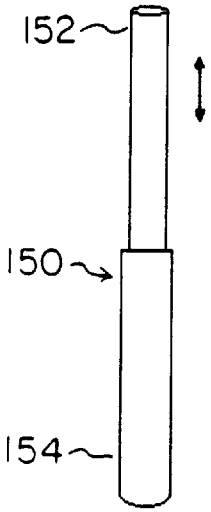
FIG. 11 is a side view of the suspension frame members of the assembly of the canopy assembly.

A plurality of suspension frame members 150, one of which is shown in FIG. 11, are included in the assembly. Each of these elongated suspension frame members are lightweight. Suspension frame member 150 can be formed from lightweight aluminum alloy material, high strength structural plastic, wood, or other lightweight high strength materials. This member can be rectangular or cylindrical, as desired. The external diameter of suspension frame member 150 is designed to be easily inserted into pockets 82, 84, 86, 88 on canopy cover 60. One source of these members, which in this embodiment were originally intended for use in window screens is MacKlanburg-Duncan Company, Oklahoma City, Okla.

Opposing ends 152, 154 of suspension frame member 150 include internal openings for receiving connection members 160, discussed below. Alternatively, opposing ends 152, 154 may have an external diameter for engagement with internal openings on connection members 160. Dowel pins (not shown) or other connectors can be used to secure longitudinally adjacent suspension frame members if additional length is necessary.

Figure 12:
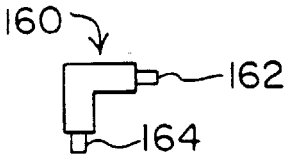
FIG. 12 is a side view of the connection members for the suspension frame.

A plurality of connection members 160, one of which is shown in FIG. 12, include opposing ends 162, 164 arranged perpendicularly from one another. Ends 162, 164 of connection member 160 are designed to engage ends 152, 154 of adjacent suspension frame members 150. This connects adjacent suspension frame members 150 together perpendicularly to form a substantially rectangularly shaped suspension frame. As stated above, this particular canopy assembly is intended for descriptive purposes only. Other configurations and sizes are considered to be within the invention.

Preferably, the suspension frame members are rods of adjustable length. These rods are similar in construction to adjustable curtain rods, and can be adjustable as shown by the arrow in FIG. 11 to fit any bed configuration, i.e., twins, full, queen and king size beds. For instance, generally, there are side rods and end rods. With the use of an adjustable side and end rods, the suspension frame can be constructed to fit variations in bed configurations. For instance, with respect to the ends of a bed, an end rod having a length of approximately 26 inches can be connected with another end rod of similar length with the use of a connector which permits one end of each end rod to be inserted into the connector. Once each rod is inserted into the connector, each rod can still be slid to adjust length of the entire connected rod. Thus, the adjustable connected rod can be configured to any length on the ends of a bed. Similarly, with respect to the sides of a bed, a side rod, for instance, having a length of 39 inches, can be connected with the same type of connector, with another side rod having similar length to create an adjustable single side rod to conform to any bed configuration. These side rods and end rods can then be interconnected with corner pieces wherein the rods are designed to engage the ends of the corner pieces to form the suspension frame. Again, these corner pieces are similar to curtain type corner pieces wherein the end and side rods interconnect with the corner pieces. In lieu of the connectors discussed above with respect to connecting two end rods or two side rods to make an adjustable piece, it is also within the bounds of the present invention to use an end rod and side rod which are already designed to be adjustable by taking one side rod having a slightly larger diameter and inserting aside rod hd or side rod having a slightly smaller diameter into the larger diameter end or side rod to create an adjustable sliding piece.

With the use of these end and side rods, the canopy cover can be attached to these rods by various methods. For instance, the canopy cover as described earlier, can have pockets in which these rods are slid into, similar to the way curtains are attached to rods. Alternatively, and more preferred, the canopy can simply be placed over the frame. However, in this method, prior to placing the canopy cover over the rods, fabric rod covers, typically having the same fabric design as the canopy cover are used. In more detail, the front and side rods of the suspension frame are slid into fabric rod covers so that the rods are concealed and the fabric rod covers blend with the canopy cover. This eliminates the need to have a canopy cover having pockets and facilitates the quick assembly of the canopy cover of the present invention.

Figure 13:
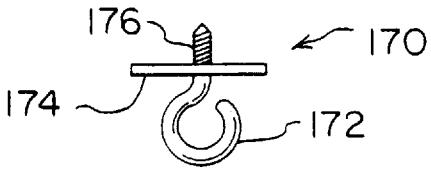
FIG. 13 is a side view of the surface mounts of the present invention.

A plurality of surface mounting hooks 170, one of which is shown in FIG. 13, are included in the assembly to suspend the suspension frame from an overhead structure. Surface mounting hooks 170 include lower hook portion 172, surface flange 174 for abutting against an overhead structure, and upper threaded portion 176 for inserting into an overhead structure, such as a ceiling.

Figure 14:
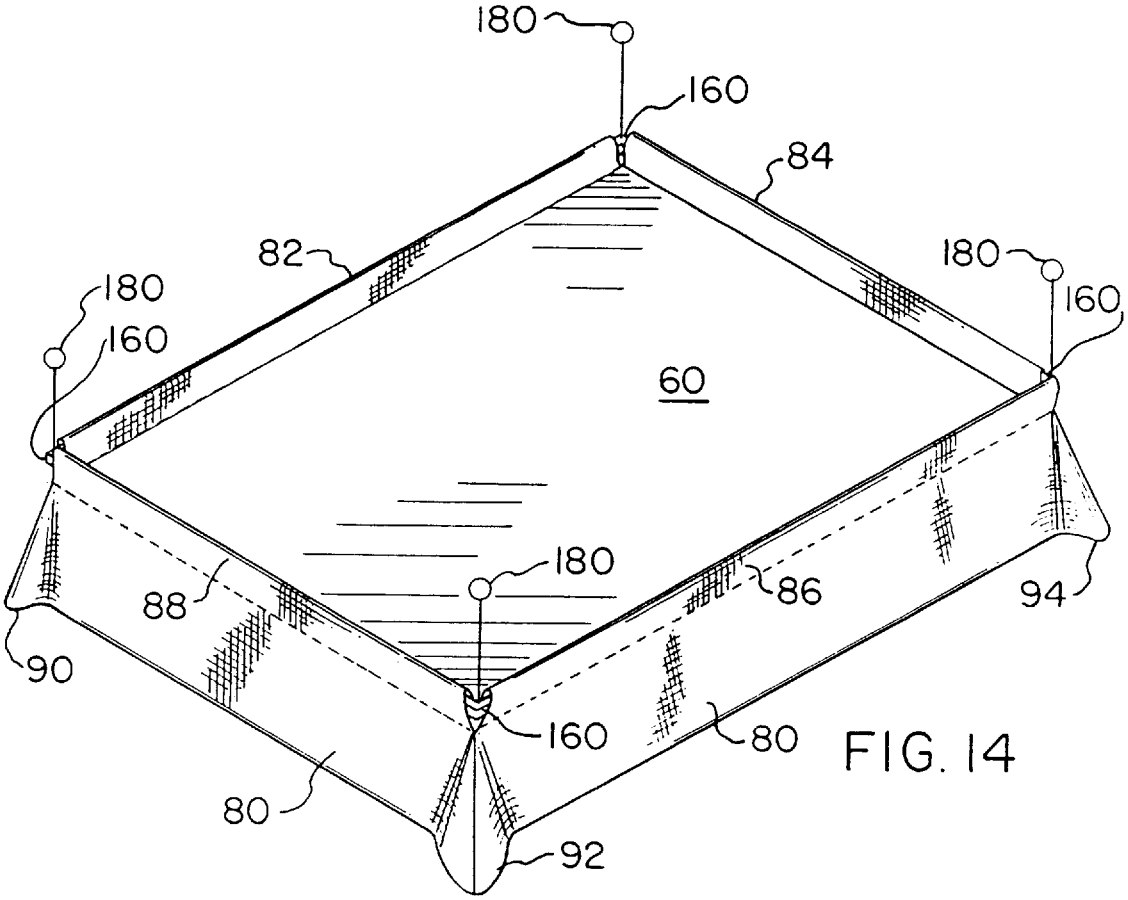
FIG. 14 is a perspective view of the assembled canopy of the embodiment of FIG. 1.

Lightweight suspension line 180, shown in FIG. 14, is used to suspend the suspension frame from the surface mounting hooks 170. Suspension line 180 can be monofilament line or other suspension methods can be used, such as decorative chain or even solid members.

As stated above, the present invention is not limited to the above exemplary embodiment. The shape and size as well as the material of the canopy cover, suspension frame, surface mounting hooks can be varied as desired.

Method of Assembly

In the exemplary preferred embodiment provided for descriptive purposes, the canopy assembly is designed to be either provided with the canopy cover as finished goods or in pattern form to be fabricated by the consumer. In either instance, the canopy cover is fabricated as discussed above.

Suspension frame members 150 are inserted through pockets 82, 84, 86, 88 of canopy cover 60. Connection members 170 are used to connect suspension frame members 150 together to form a substantially rectangularly shaped suspension frame affixed to canopy cover 60. Suspension lines 180, cut to appropriate lengths, are looped and knotted on connection members 170, as shown in FIG. 14. Suspension lines 180 can also be secured on other areas of either suspension frame members 150 or canopy cover 60.

Figure 15:
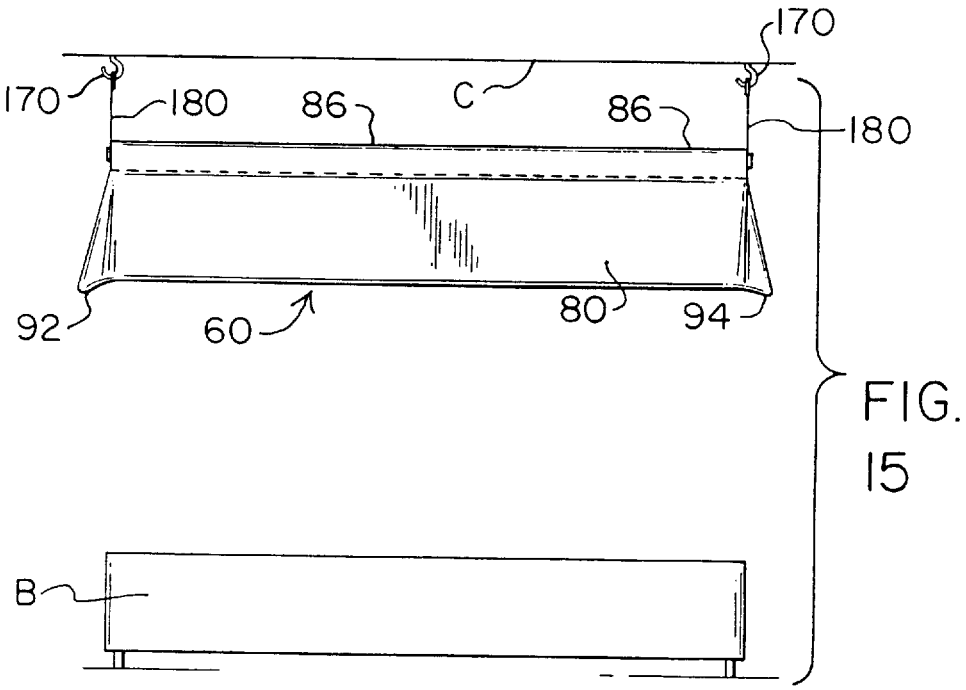
FIG. 15 is a side view of the canopy of the embodiment of FIG. 1 secured to a ceiling.

Surface mounting hooks 170 are secured to the overhead structure, such as the ceiling over a bed. Canopy cover 60 is then suspended by suspension lines 180 from surface mounting hooks 170 as shown in FIG. 15.

The edges of canopy cover 60 will drape downward in the above-described embodiment from the suspension frame members 150 to create a canopy effect. An alternative effect can be created by varying the contours of the draped edges to incorporate other designs. The insides of each of the corners form a pleat which can be tacked together to stiffen the canopy if desired.

The distinctive effect of a canopy is easily achieved in a simple procedure through the use of the canopy assembly of the above-described embodiment. This canopy assembly can be easily provided in wide range of designs, fabrics, and configurations to fit almost any application, taste and decor. The canopy can also be easily and inexpensive changed to redecorate if desired. The basic canopy assembly described above can also be supplemented by additional canopy assembly options.

Optional embodiments

Figure 16:
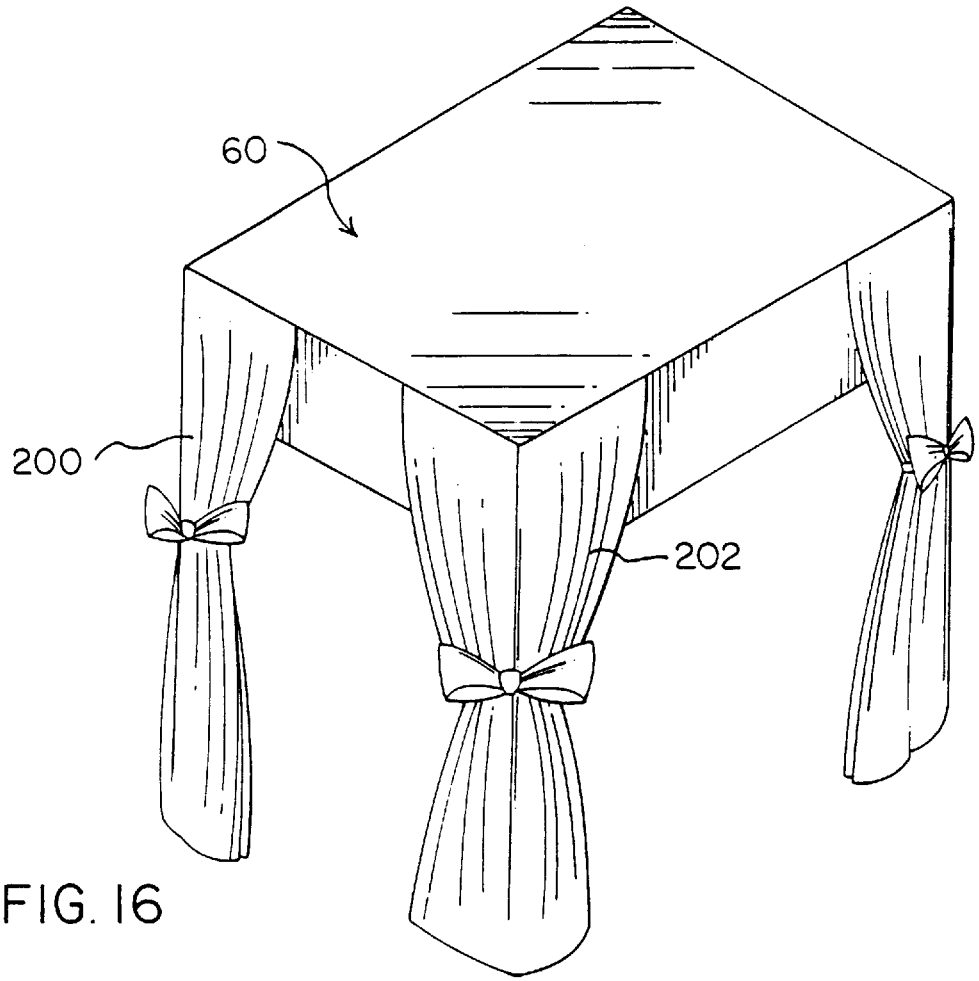
FIG. 16 is a perspective view of an optional side curtain embodiment.

One such option provides draped corners 200, 202 as shown in FIG. 16. A pattern is provided to form fabric segments which are each secured to the upper corners of canopy 60. Corners 200, 202 can be sewn flat to the upper canopy corner or shirred to create a gathered look. Additional fabric segments can be used as tiebacks on the draped corners.

Figure 17:
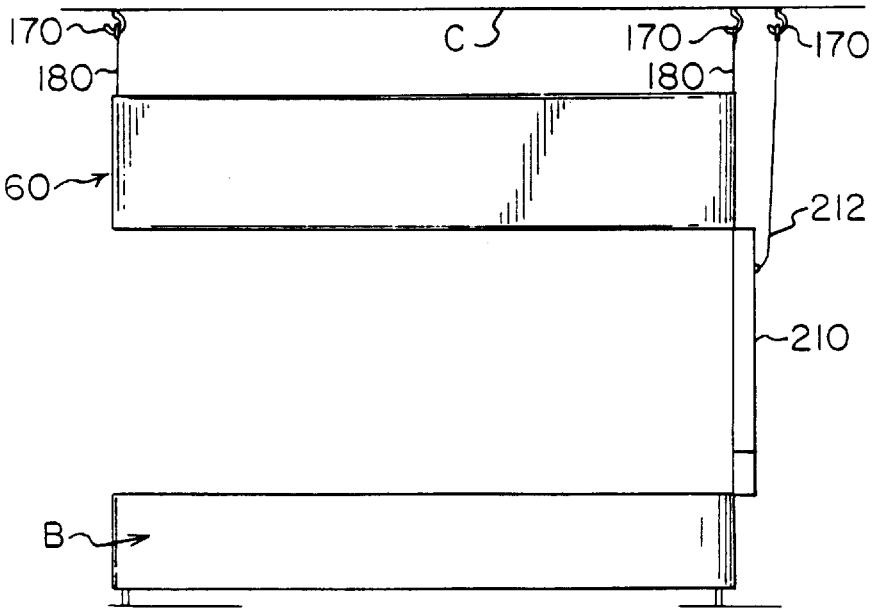
FIG. 17 is a perspective view of an optional headboard embodiment.

An additional option uses a separate pattern to create a headboard effect. Backdrop 210, as shown in FIG. 17 includes a fabric segment cut according to a selected pattern. Pockets (not shown) similar to pockets 82–88 discussed above, are formed on the backside of backdrop 210 for suspension frame members (not shown) similar to suspension frame members 150 and connection members 160 described above. Backdrop 210 is then suspended downward, or at an angle if desired, by lines 212 to create a headboard effect.

Figure 18:
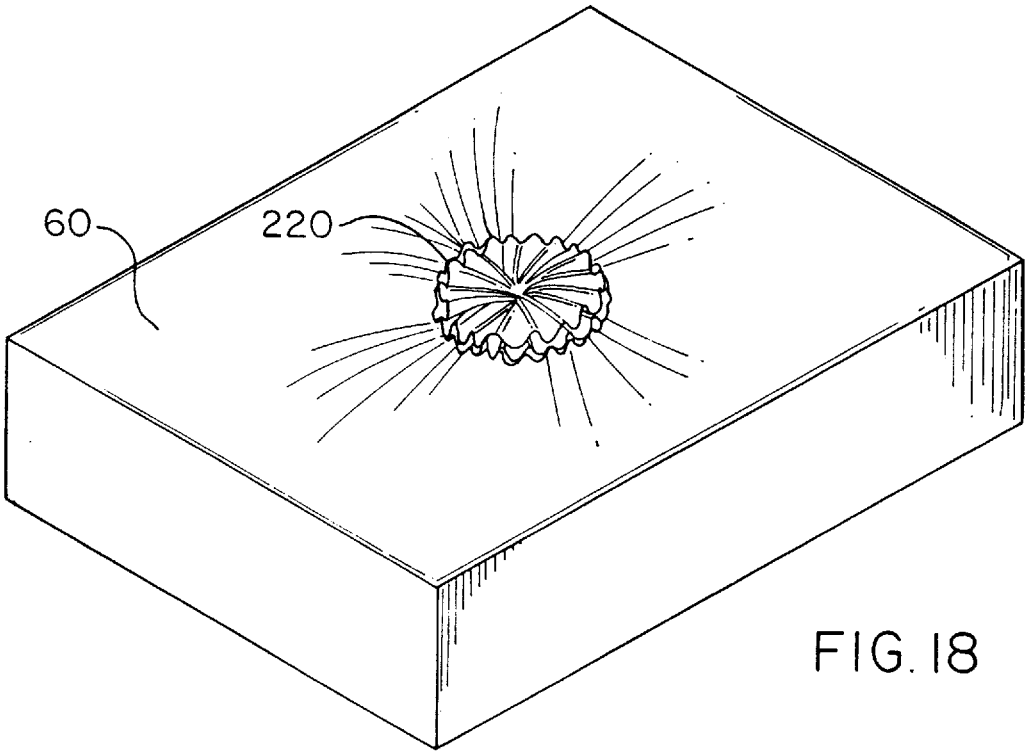
FIG. 18 is a perspective view of an optional rosette embodiment.

A third option to create a stylized canopy forms a rosette or other gathered decorative item in the center of the canopy. Rosette 220, as shown in FIG. 18, is formed by drawing shirred fabric segments 12, 32 together or by adding an additional shirred panel to canopy cover 60. Rosette 220 can then be suspended from the overhead structure by a clear thread or ribbon. Other options for providing a customized version of canopy cover 60 can be created in a similar fashion.

APPLICATIONS

As discussed throughout and repeated herein for emphasis, the canopy assembly is intended for wide ranging applications. The canopy assembly of the present invention can be packaged as finished goods for easy assembly or in pattern form to be created at an individual's home. The canopy assembly is also intended for direct marketing to institutional uses, such as hotels, hospitals, conventions, trade shows, exhibitions, children's furnishings and many others.

This canopy assembly has particular application as an overhead bed canopy. The heavy structure of rigid post canopied beds is eliminated. The effect of a bed canopy can be easily and inexpensively created for almost every decor and bed.

Other uses for the canopy assembly of the present invention includes definition of an area in a large room. For example, a child's play area can be easily created. A overhead canopy may also be desired to compensate for odd ceiling heights or room shapes. Also, these canopy assemblies may be used for exhibitions, for trade show exhibits, for hospitality suites and other such uses.

Canopy assemblies might also be created to be suspended over a walk-in tub. A window or door awning might also be created by such a canopy assembly.

An additional embodiment might use a lightweight frame, such as used in a tent, to allow a canopy to be utilized in an outdoor situation, such as for entertaining or for shade. Many other uses of the canopy assembly will become evident as the market develops.

As set forth above, the exemplary embodiments are intended for descriptive purposes only. These embodiments are not meant to limit the scope of the claimed inventive concept.

I claim:

1. A ceiling suspended canopy comprising:

a fabric canopy cover having two ends and two sides, each end and side having pockets on the top side of said canopy cover;

a plurality of suspension frame members adjustable in length for insertion into said pockets;

connection members for joining said suspension frame members together to form a suspension frame; and suspension means for suspending said suspension frame members and said canopy cover frame from a ceiling.

2. The canopy of claim 1 wherein said canopy cover is formed from a selected pattern.

3. The canopy of claim 1, wherein said suspension means includes:

mounting hooks for insertion into the ceiling; and monofilament lines extending from said mounting hooks to said suspension frame members and said canopy cover.

4. A canopy for suspending from an overhead-structure comprising:

a fabric canopy cover having two ends and two sides;

a plurality of suspension frame members adjustable in length;

a plurality of suspension frame member fabric covers connected to the canopy cover for insertion therein of said suspension frame members;

connection members joining said suspension frame members to form a suspension frame;

suspension means connected to the suspension frame for suspending said suspension frame members and said canopy cover from an overhead structure.

5. The canopy of claim 4 wherein said canopy cover is formed from a selected pattern.

6. The canopy of claim 4 wherein said suspension means include:

mounting hooks for insertion into the overhead structure; and monofilament lines extending from said mounting hooks to said suspension frame members and said canopy cover.

* * * * *